US008118691B1

(12) United States Patent
Jung

(10) Patent No.: US 8,118,691 B1
(45) Date of Patent: Feb. 21, 2012

(54) GOLF BALL ALIGNMENT TOOL

(76) Inventor: Man Young Jung, Pasadena, CA (US)

( * ) Notice: Subject to any disclaimer, the term of this patent is extended or adjusted under 35 U.S.C. 154(b) by 87 days.

(21) Appl. No.: 12/900,809

(22) Filed: Oct. 8, 2010

(51) Int. Cl.
*A63B 57/00* (2006.01)
*A63B 69/00* (2006.01)
*B41F 17/30* (2006.01)

(52) U.S. Cl. ..... 473/406; 473/257; 101/127

(58) Field of Classification Search ..... 473/257, 473/280, 285, 351, 353, 406; 101/4, 5, 35, 101/36, 114, 127, 129, DIG. 40
See application file for complete search history.

(56) References Cited

U.S. PATENT DOCUMENTS 1,476,203 A * 12/1923 Horne ..... 101/4
3,071,171 A * 1/1963 Guerrero ..... 33/524
5,878,659 A * 3/1999 Hatter ..... 101/35
6,453,807 B1 * 9/2002 Ramey ..... 101/35
6,595,128 B2 * 7/2003 Parks ..... 101/127
6,676,544 B2 * 1/2004 Tyke ..... 473/406

* cited by examiner

*Primary Examiner* — Nini Legesse
(74) *Attorney, Agent, or Firm* — Clement Cheng

(57) ABSTRACT

A golf ball alignment tool has a retaining strip having a retaining strip end. Retaining strip diagonal slots are arranged along a centerline of the retaining strip. The retaining strip has a left side edge and right side edge. A center slot formed as an opening oriented along a centerline of the retaining strip. A securing screw having securing screw thread engaging with the plurality of retaining strip diagonal slots. A golf ball is engaged within the retaining strip. The golf ball receives a right line mark on the right side edge. The golf ball receives a left line mark on the left side edge, wherein the golf ball receives a middle line mark along the center slot. The golf ball alignment tool has a tee head a tee tip and a tee shaft.

16 Claims, 2 Drawing Sheets

GOLF BALL ALIGNMENT TOOL

FIELD OF THE INVENTION

The present invention is in the field of golf ball alignment tools.

DISCUSSION OF RELATED ART

A variety of practice aids have been created for helping golfers learn the sport. Golf has been an area that has a wide range of patent literature. Putting is particularly important in golf. Learning to putt well takes a time commitment.

A variety of golf ball marking tools have been created to aid golfers with determining the orientation of the club face at the moment of impact with the ball. For example, in U.S. Pat. No. 4,603,862 to Chen, issued Aug. 5, 1986 the disclosure of which is incorporated herein by reference, an alignment marker comprises a strip mounted adjacent a grid. A device comprising a gripping portion includes an opening to engage the ball, as shown in U.S. Pat. No. 6,453,807 to Ramey, issued Sep. 24, 2002 the disclosure of which is incorporated herein by reference.

For example, in U.S. Pat. No. 6,676,544 to Tyke, issued Jan. 13, 2004 the disclosure of which is incorporated herein by reference, the golf marking guide comprises a body portion with a drawing slot positioned at the center of the ball. A device that impresses marks on a golf ball is shown in U.S. Pat. No. 4,086,851 to Brandell, issued May 2, 1978 the disclosure of which is incorporated herein by reference.

A golf ball marking guide comprises a device with edges that facilitate alignment, as shown in U.S. Pat. No. 6,716,112 to Rennecamp, issued Apr. 6, 2004 the disclosure of which is incorporated herein by reference. For example, in U.S. Pat. No. 6,004,223 to Newcomb, issued Dec. 21, 1999, the disclosure of which is incorporated herein by reference, an alignment aid consists of a spherically shaped body with intersecting slots for marking the golf ball with the intended alignment pathway. Also for example, in U.S. Pat. No. D525,300 to Helmsetter, issued Jul. 18, 2006, the disclosure of which is incorporated herein by reference, a ball marking tool includes a body with a slit for drawing a line of alignment on the golf ball.

SUMMARY OF THE INVENTION

A golf ball alignment tool has a retaining strip having a retaining strip end. Retaining strip diagonal slots are arranged along a centerline of the retaining strip. The retaining strip has a left side edge and right side edge. A center slot formed as an opening oriented along a centerline of the retaining strip. A securing screw having securing screw thread engaging with the plurality of retaining strip diagonal slots. A golf ball is engaged within the retaining strip. The golf ball receives a right line mark on the right side edge. The golf ball receives a left line mark on the left side edge, wherein the golf ball receives a middle line mark along the center slot. The golf ball alignment tool has a tee head a tee tip and a tee shaft. The securing screw opening is sized to receive a shaft of a golf tee. A bend retainer is formed as a bent portion of the retaining strip, and the bend retainer has an opening for engaging with securing screw thread to form a retaining strip screw opening. The center slot is formed as a circumferential slot receiving a diameter of a golf ball and sized to receive a marker pen tip.

The retaining strip forms band having a circular opening for receiving a golf ball. The retaining strip is sized to engage a standard size regulation golf ball. The right side edge provides a guideline for making a right line mark. The left side edge provides a guideline for making a left line mark. The middle or center slot provides a guideline for making a centerline mark on the ball. The diagonal slots provide a guideline for making a dashed line on the ball.

Figure 1:
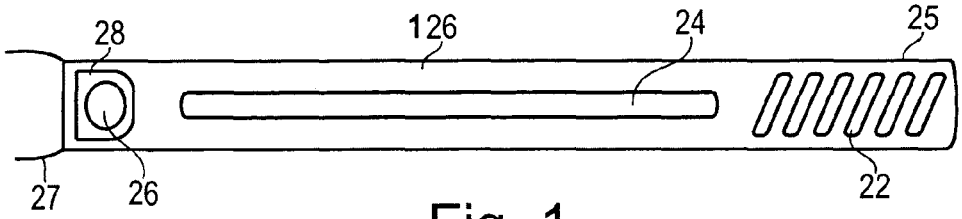
FIG. 1 is a plan view of the retaining strip.
Figure 2:
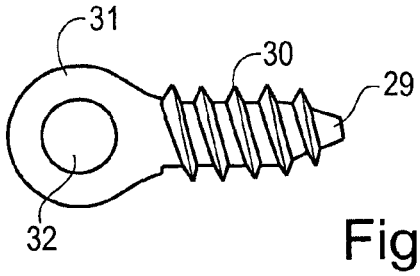
FIG. 2 is a side view of the securing screw.
Figure 3:
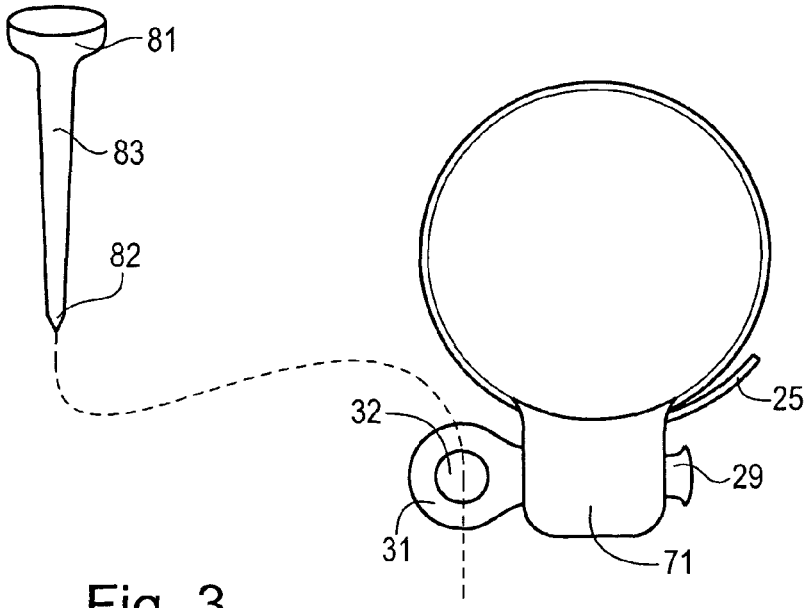
FIG. 3 is a diagram of the retaining strip in looped configuration receiving a key in the shape of a tee.
Figure 4:
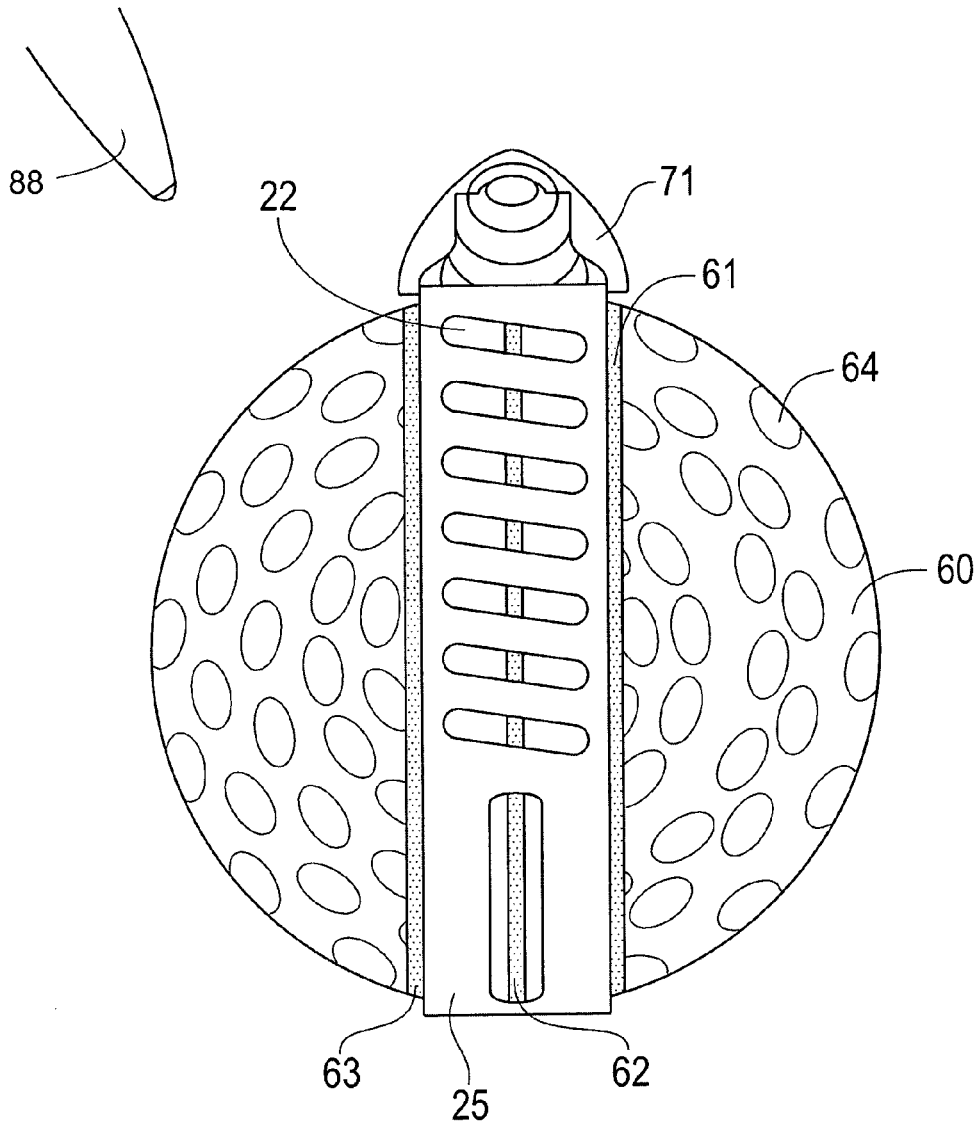
FIG. 4 is a diagram of the retaining strip looped around a golf ball and receiving markings on an exterior surface of the golf ball.

The following call out list of elements is useful as a reference for the elements of the drawings.

22 Retaining Strip Diagonal Slot
24 Retaining Strip Circumferential Slot
25 Retaining Strip End
26 Retaining Strip Screw Opening
126 Retaining Strip
27 Retaining Strip Screw Retainer
28 Retaining Strip Screw Opening Reinforcement
29 Securing Screw Tip
30 Securing Screw Thread
31 Securing Screw
32 Securing Screw Opening
60 Golf Ball
61 Right Line
62 Middle Line
63 Left Line
64 Golf Ball Dimple
71 Bend Retainer
81 Golf Tee Head
82 Golf Tee Tip
83 Golf Tee Shaft
88 Marker Pen

DETAILED DISCUSSION OF THE PREFERRED EMBODIMENT

The golf ball alignment tool is made of several parts and includes a retaining strip 126, a securing screw 31, a golf tee, a marker 88 and a golf ball 60. A user places the golf ball in the retaining strip and secures it with the securing screw 31. The user then marks the golf ball with a left line 63, a right line 61 and a middle line 62.

FIG. 1 shows a retaining strip. The retaining strip is preferably made of a metal flexible strip that has been punched. The retaining strip has a plurality of diagonal slots 22 arranged in parallel configuration for engaging with threads of a securing screw 31. The diagonal slots 22 are before the retaining strip end 25. The middle of the retaining strip has a retaining strip circumferential slot 24. The retaining strip screw opening 26 provides a slot for marking the golf ball.

When removed from the golf ball alignment tool, the golf ball will have a right line 61, a middle line 62 and a left line 63. The middle line 62 has a dashed portion formed by a line drawn through and over the plurality of retaining strip diagonal slots 22. The middle line also has a continuous portion formed by the retaining strip circumferential slot 24. The retaining strip 126 also has a retaining portion made up of a retaining strip screw opening 26 and a retaining strip screw opening reinforcement 28. A pair of retaining strip screw retainers 27 preferably bound an upper and lower portion of the retaining end of the retaining strip.

The securing screw 31 has a securing screw opening 32 and a plurality of securing screw thread 30. The securing screw 31 also has a securing screw tip 29. The securing screw opening 32 is sized to receive a shaft of a golf tee. The golf tee generally has a golf tee head 81, a golf tee tip 82 and a golf tee shaft 83. The golf ball 60 has a golf ball dimple 64 and three lines. The retaining strip end 25 fits into the bend retainer 71. As the bend retainer is tightened by the securing screw, the retaining strip 126 secures to the golf ball. The securing screw acts as a worm gear engaging with the diagonal slots 22.

The bend retainer 71 fits over as a band and clamps onto the retaining strip 126. The bend retainer 71 has a pair of edges that may receive a plurality of securing screw thread 30. The bend can be bent so that the securing strip screw opening 26 in cages with the retaining strip screw retainer 27. The retaining strip screw retainer 27 with the retaining strip screw opening 26 together may form the bend retainer 71.

The bend retainer can be formed in a variety of different configurations, such as those commonly used for hose clamps as seen and described in Belik, U.S. Pat. No. 5,622,391 issued Apr. 22, 1997, the disclosure of which is incorporated herein by reference. Other hose clamp methods, such as described in Tetzlaff U.S. Pat. No. 3,407,449 issued Oct. 29, 1968 provide for a pair of protruding retainers of which the retaining screw connects between. Thus, a wide variety of different configurations can be used for holding a golf ball and providing a left line, a right line and a middle line having a continuous portion and a dashed portion. For example, in Morrison U.S. Pat. No. 6,685,229 issued Feb. 3, 2004, the disclosure of which is incorporated herein by reference, a thumbscrew key is used to turn the word gear.

The retaining strip screw opening 26 can be formed as a pair on a pair of retaining strip screw opening reinforcement 28 which are formed as tabs that can be flipped out to engage with retaining strip screw retainer 27 so as to form the bend retainer 71.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims. Persons skilled in this art will readily appreciate that various additional changes and modifications may be made without departing from the spirit of the invention, as defined and differentiated by the following claims.

The invention claimed is:

1. A golf ball alignment tool comprising:

a. a retaining strip having a retaining strip end;

b. a plurality of retaining strip diagonal slots arranged along a centerline of the retaining strip, wherein the retaining strip has a left side edge and right side edge;

c. a center slot formed as an opening oriented along a centerline of the retaining strip;

d. a securing screw having securing screw thread engaging with the plurality of retaining strip diagonal slots;

e. a golf ball engaged within the retaining strip, wherein the golf ball receives a right line mark on the right side edge, wherein the golf ball receives a left line mark on the left side edge, wherein the golf ball receives a middle line mark along the center slot.

2. The golf ball alignment tool of claim 1, further comprising a golf tee, wherein the golf tee has a tee head a tee tip and a tee shaft, wherein the securing screw opening is sized to receive a shaft of a golf tee.

3. The golf ball alignment tool of claim 1, further comprising a bend retainer formed as a bent portion of the retaining strip, wherein the bend retainer has an opening for engaging with securing screw thread to form a retaining strip screw opening.

4. The golf ball alignment tool of claim 1, wherein the center slot is formed as a circumferential slot receiving a diameter of a golf ball and sized to receive a marker pen tip.

5. The golf ball alignment tool of claim 1, further comprising a bend retainer formed as a bent portion of the retaining strip, wherein the bend retainer has an opening for engaging with securing screw thread to form a retaining strip screw opening, further comprising a golf tee, wherein the golf tee has a tee head a tee tip and a tee shaft, wherein the securing screw opening is sized to receive a shaft of a golf tee.

6. The golf ball alignment tool of claim 1, wherein the center slot is formed as a circumferential slot receiving a diameter of a golf ball and sized to receive a marker pen tip, further comprising a golf tee, wherein the golf tee has a tee head a tee tip and a tee shaft, wherein the securing screw opening is sized to receive a shaft of a golf tee.

7. The golf ball alignment tool of claim 1, further comprising a bend retainer formed as a bent portion of the retaining strip, wherein the bend retainer has an opening for engaging with securing screw thread to form a retaining strip screw opening, wherein the center slot is formed as a circumferential slot receiving a diameter of a golf ball and sized to receive a marker pen tip.

8. The golf ball alignment tool of claim 1, further comprising a golf tee, wherein the golf tee has a tee head a tee tip and a tee shaft, wherein the securing screw opening is sized to receive a shaft of a golf tee; and a bend retainer formed as a bent portion of the retaining strip, wherein the bend retainer has an opening for engaging with securing screw thread to form a retaining strip screw opening, wherein the center slot is formed as a circumferential slot receiving a diameter of a golf ball and sized to receive a marker pen tip.

9. A golf ball alignment tool comprising:

a. a retaining strip having a retaining strip end;

b. a plurality of retaining strip diagonal slots arranged along a centerline of the retaining strip, wherein the retaining strip has a left side edge and right side edge;

c. a center slot formed as an opening oriented along a centerline of the retaining strip;

d. a securing screw having securing screw thread engaging with the plurality of retaining strip diagonal slots; wherein the retaining strip forms band having a circular opening for receiving a golf ball, wherein the retaining strip is sized to engage a standard size regulation golf ball, wherein the right side edge provides a guideline for making a right line mark, wherein the left side edge provides a guideline for making a left line mark.

10. The golf ball alignment tool of claim 9, further comprising a golf tee, wherein the golf tee has a tee head a tee tip and a tee shaft, wherein the securing screw opening is sized to receive a shaft of a golf tee.

11. The golf ball alignment tool of claim 9, further comprising a bend retainer formed as a bent portion of the retaining strip, wherein the bend retainer has an opening for engaging with securing screw thread to form a retaining strip screw opening.

12. The golf ball alignment tool of claim 9, wherein the center slot is formed as a circumferential slot receiving a diameter of a golf ball and sized to receive a marker pen tip.

13. The golf ball alignment tool of claim 9, wherein the golf ball center slot is sized to provide a middle line mark along the center slot.

14. The golf ball alignment tool of claim 13, further comprising a golf tee, wherein the golf tee has a tee head a tee tip and a tee shaft, wherein the securing screw opening is sized to receive a shaft of a golf tee.

15. The golf ball alignment tool of claim 13, further comprising a bend retainer formed as a bent portion of the retaining strip, wherein the bend retainer has an opening for engaging with securing screw thread to form a retaining strip screw opening.

16. The golf ball alignment tool of claim 13, wherein the center slot is formed as a circumferential slot receiving a diameter of a golf ball and sized to receive a marker pen tip.

* * * * *